US011089400B2

(12) United States Patent
Tao et al.

(10) Patent No.: US 11,089,400 B2
(45) Date of Patent: Aug. 10, 2021

(54) COAXIAL LOUDSPEAKER

(71) Applicant: SUZHOU SONAVOX ELECTRONICS CO., LTD, JiangSu (CN)

(72) Inventors: Shenggang Tao, JiangSu (CN); Kaihua Qian, JiangSu (CN); Yuewu Shen, JiangSu (CN); Xiaoqing Wang, JiangSu (CN); Guoqiang Chai, JiangSu (CN)

(73) Assignee: SUZHOU SONAVOX ELECTRONICS CO., LTD, JiangSu (CN)

( * ) Notice: Subject to any disclaimer, the term of this patent is extended or adjusted under 35 U.S.C. 154(b) by 211 days.

(21) Appl. No.: 16/466,246

(22) PCT Filed: Sep. 21, 2018

(86) PCT No.: PCT/CN2018/106926
§ 371 (c)(1),
(2) Date: Jun. 3, 2019

(87) PCT Pub. No.: WO2019/227787
PCT Pub. Date: Dec. 5, 2019

(65) Prior Publication Data

US 2021/0136482 A1 May 6, 2021

(30) Foreign Application Priority Data

May 28, 2018 (CN) ..... 201820805618.9

(51) Int. Cl.
*H04R 1/24* (2006.01)
*H04R 9/06* (2006.01)
(Continued)

(52) U.S. Cl.
CPC ..... *H04R 1/24* (2013.01); *H04R 7/12* (2013.01); *H04R 9/045* (2013.01); *H04R 9/06* (2013.01); *H04R 9/063* (2013.01)

(58) Field of Classification Search
CPC . H04R 1/24; H04R 7/12; H04R 9/045; H04R 9/06; H04R 9/063
See application file for complete search history.

(56) References Cited

U.S. PATENT DOCUMENTS 3,796,839 A * 3/1974 Torn ..... H04R 1/24 381/432
4,821,331 A 4/1989 Murayama et al.
2006/0023903 A1 2/2006 Hayashi et al.

FOREIGN PATENT DOCUMENTS

CN 104581563 A 4/2015
JP H08163692 A 6/1996

OTHER PUBLICATIONS

International Search Report and Written Opinion for PCT Application No. PCT/CN2018/106926, dated Jan. 16, 2019 in 8 pages.

* cited by examiner

*Primary Examiner* — Mark Fischer
(74) *Attorney, Agent, or Firm* — Knobbe, Martens, Olson & Bear, LLP

(57) ABSTRACT

The present disclosure relates to a coaxial speaker, which has better dust-proof and water-proof performance. The coaxial loudspeaker comprises a bass unit and a high-pitched unit coaxially arranged, the bass unit comprises a T-iron, a diaphragm and a voice coil connected to the diaphragm. The coaxial loudspeaker further comprises a cabin fixed on the T-iron, a lower portion of the cabin passes through the voice coil to connect with the T-iron, a top end portion of the cabin is located above the diaphragm, the high-pitched unit is arranged on the top end portion of the
(Continued)

cabin, and the coaxial loudspeaker further comprises a dust-proof ring having an upper edge connected with the top end portion of the cabin and a lower edge connected with the upper portion of the voice coil.

19 Claims, 2 Drawing Sheets

(51) Int. Cl.
*H04R 7/12* (2006.01)
*H04R 9/04* (2006.01)

COAXIAL LOUDSPEAKER

CROSS-REFERENCE TO RELATED APPLICATIONS

The present application is the U.S. National Phase under 35. U.S.C. § 371 of International Application PCT/CN2018/106926, filed Sep. 21, 2018, which claims priority of Chinese Patent Application No. CN 201820805618.9, filed on May 28, 2018, the entire content of which is incorporated herein by reference.

FIELD OF THE INVENTION

The invention relates to the field of loudspeaker, in particular to a coaxial loudspeaker.

BACKGROUND OF THE INVENTION

A coaxial loudspeaker comprises a high-pitched speaker and a mid-bass loudspeaker arranged along a same axis, and responsible for reproducing high-pitch and mid-bass, respectively. The advantage is that it increases the frequency width of single speaker greatly and is widely used in car audio.

Generally, in coaxial loudspeaker, the high-pitched unit is mounted on the T-iron of the bass unit through a frame passing through the voice coil of the bass unit, which cause that the dust-proof cover cannot be installed on the bass unit. Water and sundries etc. enter the magnetic system through the voice coil interior, which will greatly reduce the service life of the loudspeaker unit. Especially used in car, the requirements for sealing and waterproofing of coaxial speakers are higher.

SUMMARY OF THE INVENTION

In order to solve the above-mentioned problems, the present disclosure aims to provide a coaxial loudspeaker, which has better dust-proof and water-proof performance.

In order to achieve the above purpose, the present disclosure provides a coaxial loudspeaker, comprising a bass unit and a high-pitched unit coaxially arranged, the bass unit comprises a T-iron, a diaphragm and a voice coil connected to the diaphragm, wherein the coaxial loudspeaker further comprises a cabin fixed on the T-iron, a lower portion of the cabin passes through the voice coil to connect with the T-iron, a top end portion of the cabin is located above the diaphragm, the high-pitched unit is arranged on the top end portion of the cabin, and the coaxial loudspeaker further comprises a dust-proof ring having an upper edge connected with the top end portion of the cabin and a lower edge connected with an upper portion of the voice coil.

In an embodiment, an orthographic projection of the dust-proof ring on a horizontal plane is not greater than that of the cabin on the horizontal plane and is covered by the orthographic projection of the cabin.

In an embodiment, the cabin is fixed on the T-iron through a connector, and an upper end portion of the connector is fixedly connected to the high-pitched unit, and the dust-proof ring surrounds the connector and the lower portion of the cabin.

In an embodiment, the connector extends in a vertical direction.

In an embodiment, the cross section of the dust-proof ring in the vertical direction has a plurality of bent portions.

In an embodiment, the plurality of bent portions comprise a first bent portion and a second bent portion that are arranged up and down and connected with each other, the first bent portion is a first arc that protrudes inward in a direction close to the connector, the second bent portion is a second arc that protrudes outward in a direction away from the connector. The first bent portion is located above or below the second bent portion.

In an embodiment, the first arc and the second arc are respectively semi-circular arcs.

In an embodiment, the connector is a bolt.

In an embodiment, a mounting hole is opened on a middle part of the diaphragm, the voice coil passes though the mounting hole and is fixedly connected to hole-wall of the mounting hole, and the connector passes though the voice coil.

In an embodiment, a material of the dust-proof ring is rubber and is respectively bonded to the top end portion of the cabin and the voice coil.

Due to the use of the above scheme, the present disclosure has the following advantages compared with the prior art:

Since the dust-proof ring is installed between the voice coil of the bass unit of the coaxial speaker and the top end portion of the cabin, water and debris cannot enter the magnetic circuit system through the voice coil, and the sealing effect is better, and the waterproof and dustproof performance is greatly improved.

BRIEF DESCRIPTION OF THE DRAWINGS

In order to illustrate the technical scheme of the present disclosure more clearly, the drawings used in the description of the embodiments will be briefly introduced below. Obviously, the drawings in the following description are only some embodiments of the present disclosure, and the persons skilled in the art can obtain other drawings according to these drawings without any creative work.

Wherein:

1—bass unit; 11—frame; 12—diaphragm; 13—voice coil; 14—T-iron; 15—front panel; 16—magnetic steel; 2—high-pitched unit; 3—cabin; 31—top end portion; 32—lower portion; 4—bolt; 5—dust-proof ring; 51—first bent portion; 52—second bent portion.

DETAILED DESCRIPTION OF THE INVENTION

The preferred embodiments of the present disclosure are described in detail below with the drawings in order to make the advantages and features of the present disclosure more readily understood by the persons skilled in the art. It is to be noted that the description of the embodiments is used to help understand the present disclosure, but is not intended to limit the invention. Further, the technical features involved in the various embodiments of the present disclosure described below may be combined with each other as long as they do not constitute a conflict with each other.

Figure 1:
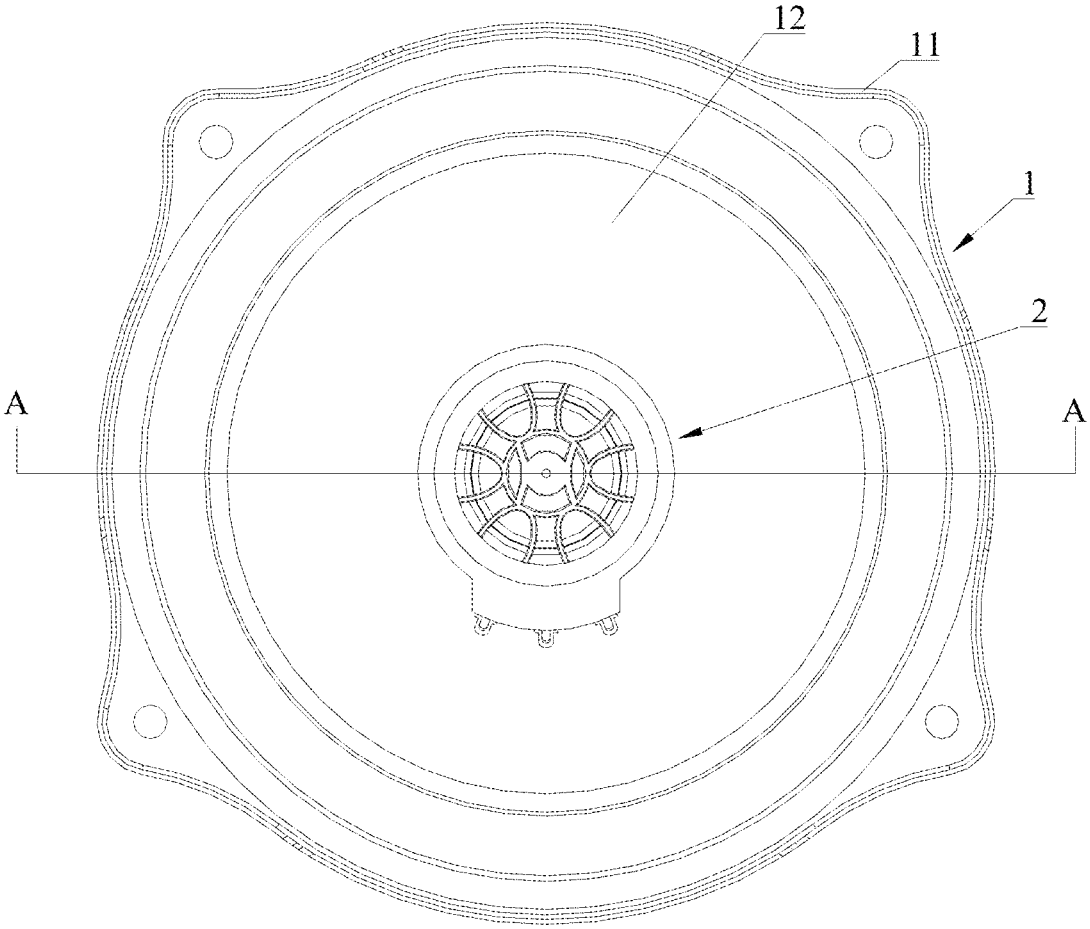
FIG. 1 is a top view of a coaxial speaker according to the present disclosure.
Figure 2:
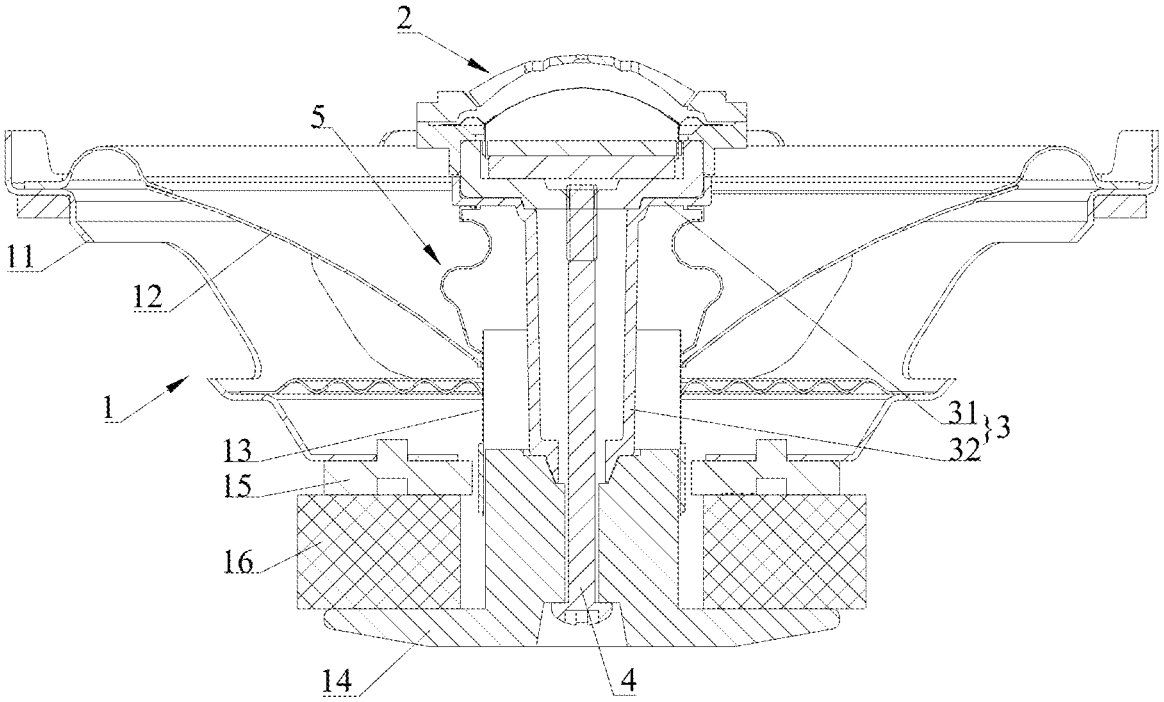
FIG. 2 is a sectional view of the A-A direction in FIG. 1.
Figure 3:
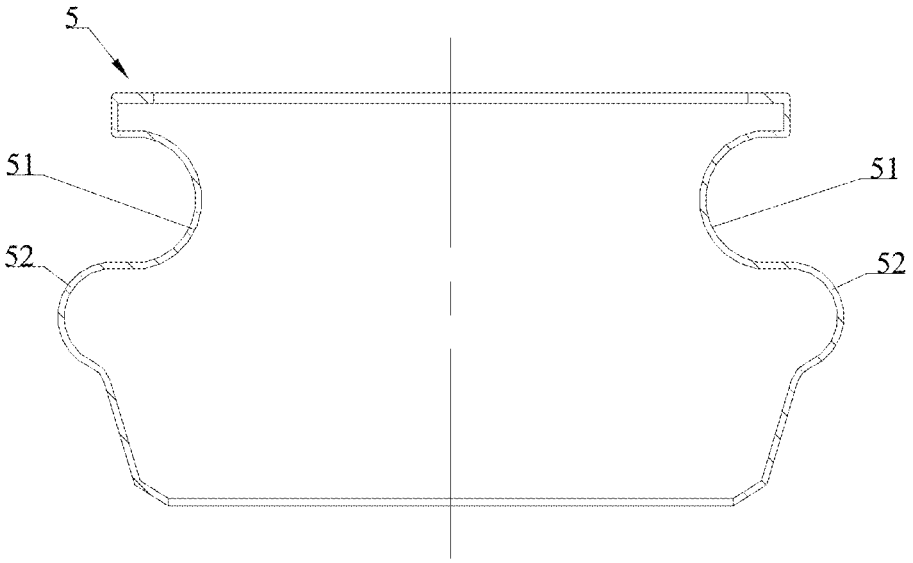
FIG. 3 is an enlarged schematic view of the dust ring in FIG. 2.

FIGS. 1-3 illustrate a coaxial speaker according to the present disclosure. Referring to FIG. 1, the coaxial speaker comprises a bass unit 1 and a high-pitched unit 2 coaxially arranged. Bass unit 1 specifically comprises a frame 11, a front panel 15, a magnetic steel 16 and a T-iron 14 fixedly connected in turn from top to bottom, wherein the front panel 15 and the magnetic steel 16 are arranged around the T-iron 14 and forming a magnetic gap with the T-iron 14, the diaphragm 12 is fixedly arranged on the frame 11, and the diaphragm 12 in FIG. 1 is specifically a paper cone, a voice coil 13 is fixedly arranged on the diaphragm 12, and a lower portion of the voice coil 13 is inserted into the magnetic gap. Specifically, in the embodiment, the middle portion of the diaphragm 12 is provided with a mounting hole and the voice coil 13 passes though the mounting hole and fixedly connected to the hole-wall of the mounting hole, and the upper end portion of the voice coil 13 extends above the diaphragm 12.

The coaxial speaker also comprises a cabin 3 that is fixedly arranged on the T-iron 14. Specifically, the lower portion 32 of the cabin 3 passes through the voice coil 13 to be in contact with the T iron 14, and the top end portion 31 of the cabin 3 is located above the diaphragm 12. The high-pitched unit 2 is arranged on the top end portion 31 of the cabin 3. Further, the cabin 3 is fixed on the T-iron 14 through a connector, and the connector extends in the vertical direction. The connector in this embodiment is specifically a bolt 4 extending in the vertical direction, and the bolt 4 passes through the T-iron 14 and the lower portion 32 of the cabin 3 in turn from top to bottom, the upper end portion thereof is fixedly connected to the high-pitched unit 2, that is to say, the bass unit 1, the cabin 3 and the high-pitched unit 2 are fastened and connected by the bolt 4.

The coaxial speaker further comprises a dust-proof ring 5, having an upper edge connected to the top end portion 31 of the cabin 3 and a lower edge connected to the upper portion of the voice coil 13. The material of the dust-proof ring 5 is specifically rubber, the upper edge thereof is bonded to the bottom surface of the top end portion 31 of the cabin 3, the lower edge is bonded to the upper end portion of the voice coil 13, and the dust-proof ring 5 is arranged around the lower portion 32 of the cabin 3 and the bolt 4, that is to say, the dust-proof ring 5 is annular and seals off the lower portion 32 of the cabin 3 and the bolt 4.

It should also be noted that the orthographic projection of the dust-proof ring 5 on the horizontal plane is not greater than the orthographic projection of the cabin 3 on the horizontal plane and is covered by the orthographic projection of the cabin 3. As shown in FIG. 1, when the coaxial speaker is viewed from above, the dust-proof ring 5 is completely sheltered by the high-pitched unit 2 and the top end portion 31 of the cabin 3, and is not visible. Furthermore, the cross section of the dust-proof ring 5 in the vertical direction has a plurality of bent portions. Referring to FIG. 3, in the embodiment, the plurality of bent portions specifically comprise a first bent portion 51 and a second bent portion 52 that are arranged up and down and connected with each other. The first bent portion 51 is a first arc that protrudes inward in a direction close to the bolt 4, the second bent portion 52 is a second arc that protrudes outward in a direction away from the bolt 4. The central angles of the first arc and the second arc are respectively less than or equal to 180°, preferably a semi-circular arc.

The coaxial speaker has the following advantages: after the dust-proof ring 5 is installed on the outer side of the voice coil 13 of the bass unit 1 of the coaxial speaker, water and debris cannot enter the magnetic circuit system through the voice coil 13, the sealing and the waterproof performance is greatly improved; the dust-proof ring 5 has a small projection area in the vibration direction of the paper cone (i.e., the vertical direction shown in FIG. 2), thereby has less influence on the frequency response and distortion performance of the speaker; the cross section design consisting of two semi-circular arcs (the first bent portion 51 and the second bent portion 52) prevents the dust-proof ring 5 from colliding during the up and down movement of paper cone, thereby avoids the generation of abnormal sounds.

The above embodiments are only to illustrate the technical conception and characteristics of the present disclosure, and are a preferred embodiment. It is intended that the persons skilled in the art will be able to understand the contents of the present disclosure and implement it accordingly, but does not limit the protection scope of the present disclosure.

What is claimed is:

1. A coaxial loudspeaker comprising a bass unit and a high-pitched unit coaxially arranged, wherein the bass unit comprises a T-iron, a diaphragm and a voice coil connected to the diaphragm, the coaxial loudspeaker further comprises a cabin fixed on the T-iron, a lower portion of the cabin passes through the voice coil, a top end portion of the cabin is located above the diaphragm, the high-pitched unit is arranged on the top end portion of the cabin, the coaxial loudspeaker further comprises a dust-proof ring having an upper edge connected with the top end portion of the cabin and a lower edge connected with the upper portion of the voice coil, wherein an orthographic projection of the dust-proof ring on a horizontal plane is not greater than that of the cabin on the horizontal plane and is covered by the orthographic projection of the cabin.

2. The coaxial loudspeaker according to claim 1, wherein the cabin is fixed on the T-iron through a connector, and an upper end portion of the connector is fixedly connected to the high-pitched unit, and the dust-proof ring surrounds the connector and the lower portion of the cabin.

3. The coaxial loudspeaker according to claim 2, wherein the connector extends in a vertical direction.

4. The coaxial loudspeaker according to claim 3, wherein the cross section of the dust-proof ring in the vertical direction has a plurality of bent portions.

5. The coaxial loudspeaker according to claim 4, wherein the plurality of bent portions comprise a first bent portion and a second bent portion that are connected with each other, the first bent portion is a first arc that protrudes inward in a direction close to the connector, the second bent portion is a second arc that protrudes outward in a direction away from the connector.

6. The coaxial loudspeaker according to claim 5, wherein the first arc and the second arc are respectively semi-circular arcs.

7. The coaxial loudspeaker according to claim 5, wherein the first bent portion is located above or below the second bent portion.

8. The coaxial loudspeaker according to claim 2, wherein the connector is a bolt.

9. The coaxial loudspeaker according to claim 2, wherein a mounting hole is opened on a middle part of the diaphragm, the voice coil passes though the mounting hole and is fixedly connected to hole-wall of the mounting hole, and the connector passes though the voice coil.

10. The coaxial loudspeaker according to claim 1, wherein a material of the dust-proof ring is rubber and is respectively bonded to the top end portion of the cabin and the voice coil.

11. A coaxial loudspeaker comprising a bass unit and a high-pitched unit coaxially arranged, wherein the bass unit comprises a T-iron, a diaphragm and a voice coil connected to the diaphragm, the coaxial loudspeaker further comprises a cabin fixed on the T-iron, a lower portion of the cabin passes through the voice coil, a top end portion of the cabin is located above the diaphragm, the high-pitched unit is arranged on the top end portion of the cabin, the coaxial loudspeaker further comprises a dust-proof ring having an upper edge connected with the top end portion of the cabin and a lower edge connected with the upper portion of the voice coil, wherein a material of the dust-proof ring is rubber and is respectively bonded to the top end portion of the cabin and the voice coil.

12. The coaxial loudspeaker according to claim 11, wherein the cabin is fixed on the T-iron through a connector, and an upper end portion of the connector is fixedly connected to the high-pitched unit, and the dust-proof ring surrounds the connector and the lower portion of the cabin.

13. The coaxial loudspeaker according to claim 12, wherein the connector extends in a vertical direction.

14. The coaxial loudspeaker according to claim 13, wherein the cross section of the dust-proof ring in the vertical direction has a plurality of bent portions.

15. The coaxial loudspeaker according to claim 14, wherein the plurality of bent portions comprise a first bent portion and a second bent portion that are connected with each other, the first bent portion is a first arc that protrudes inward in a direction close to the connector, the second bent portion is a second arc that protrudes outward in a direction away from the connector.

16. The coaxial loudspeaker according to claim 15, wherein the first arc and the second arc are respectively semi-circular arcs.

17. The coaxial loudspeaker according to claim 15, wherein the first bent portion is located above or below the second bent portion.

18. The coaxial loudspeaker according to claim 12, wherein the connector is a bolt.

19. The coaxial loudspeaker according to claim 12, wherein a mounting hole is opened on a middle part of the diaphragm, the voice coil passes though the mounting hole and is fixedly connected to hole-wall of the mounting hole, and the connector passes though the voice coil.

* * * * *